US009574849B2

(12) United States Patent
Hakanson et al.

(10) Patent No.: US 9,574,849 B2
(45) Date of Patent: Feb. 21, 2017

(54) FIRE-CONTROL SYSTEM

(71) Applicant: GS Development AB, Malmo (SE)

(72) Inventors: Hakan Hakanson, Lund (SE); Ralf Wiklund, Odakra (SE); Kjell Gunnarsson, Hoor (SE); Mikael Brandt, Staffanstorp (SE); Hakan Trulsson, Malmo (SE)

(73) Assignee: AIMPOINT AB, Malmo (SE)

( * ) Notice: Subject to any disclaimer, the term of this patent is extended or adjusted under 35 U.S.C. 154(b) by 0 days.

(21) Appl. No.: 14/803,731

(22) Filed: Jul. 20, 2015

(65) Prior Publication Data

US 2016/0033233 A1 Feb. 4, 2016

Related U.S. Application Data

(63) Continuation of application No. 13/382,072, filed as application No. PCT/EP2010/059419 on Jul. 2, 2010, now Pat. No. 9,115,956.

(30) Foreign Application Priority Data

Jul. 8, 2009 (SE) ..... 0950541

(51) Int. Cl.
*F41G 1/30* (2006.01)
*F41G 3/00* (2006.01)
(Continued)

(52) U.S. Cl.
CPC ..... *F41G 3/005* (2013.01); *F41G 1/30* (2013.01); *F41G 1/473* (2013.01); *F41G 3/06* (2013.01); *F41G 3/08* (2013.01)

(58) Field of Classification Search
CPC ..... F41G 1/30; F41G 3/06; F41G 3/08; F41G 1/473; G02B 23/105; G02B 23/14
(Continued)

(56) References Cited

U.S. PATENT DOCUMENTS 4,671,165 A 6/1987 Heidmann et al.
2006/0162226 A1 7/2006 Tai

FOREIGN PATENT DOCUMENTS

EP 0 028 098 A1 5/1981
EP 1 748 273 A1 1/2007
(Continued)

OTHER PUBLICATIONS

International Search Report, corresponding to PCT/EP2010/059419, date of mailing Oct. 6, 2010.
(Continued)

*Primary Examiner* — Joshua Freeman
(74) *Attorney, Agent, or Firm* — Renner, Otto, Boisselle & Sklar, LLP

(57) ABSTRACT

A fire-control system including a housing, a light channel, a light source, and a processor. Through the light channel, a user may directly observe a target and receive visually displayed information simultaneously. The light channel includes partially reflective optics and allows for visualization of a reticle to the user via the partially reflective optics. A measure of the distance to the target is also received by the system. The processor is for determining the adequate position of the reticle, based on the distance to the target, and for controlling the light source to emit light so that the reticle is visualized at the adequate position. The light source is an array capable of selectively emitting light in well defined locations on its surface.

8 Claims, 4 Drawing Sheets

(51) Int. Cl.
*F41G 1/473* (2006.01)
*F41G 3/06* (2006.01)
*F41G 3/08* (2006.01)

(58) Field of Classification Search
USPC ..... 42/131, 130, 111, 114, 132, 119, 123
See application file for complete search history.

(56) References Cited

FOREIGN PATENT DOCUMENTS

| | | | |
|---|---|---|---|
| EP | 2 034 350 | A2 | 3/2009 |
| WO | 2005/015285 | A2 | 2/2005 |

OTHER PUBLICATIONS

Written Opinion of the International Searching Authority, corresponding to PCT/EP2010/059419, date of mailing Oct. 6, 2010.

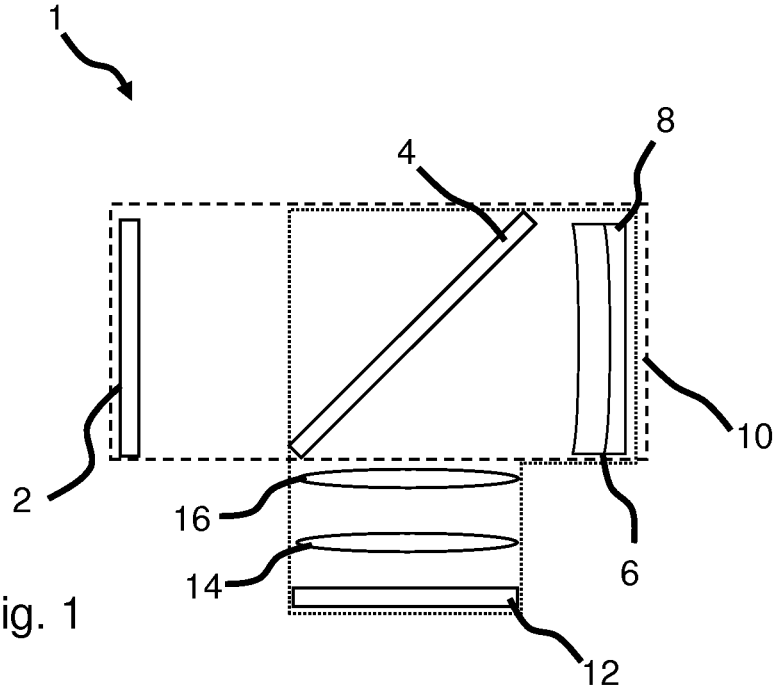
Fig. 1
Fig. 2A
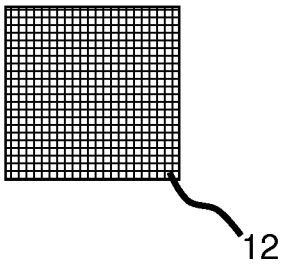
Fig. 2B
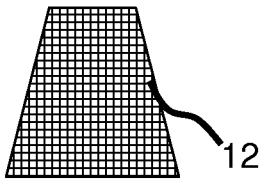

FIRE-CONTROL SYSTEM

RELATED APPLICATIONS

This application is a continuation of U.S. application Ser. No. 13/382,072 filed Mar. 15, 2012, which claims benefit of International Application No. EP2010/059419 filed Jul. 2, 2010, which claims benefit of Swedish Patent No. 0950541-3 filed Jul. 8, 2009, all of the aforesaid applications are hereby incorporated herein with reference.

FIELD OF THE INVENTION

The present invention relates to a fire-control system, and in particular to a fire-control system adapted for use with a weapon firing ammunition with a relatively high trajectory or firing with low-trajectory ammunition at longer distances. The invention also relates to a method of displaying a reticle and to a computer program for executing said method.

TECHNICAL BACKGROUND

When using ammunition with low exit velocity, high trajectory or firing at targets at a significant distance, where the time of flight is significant, the weapon sight has to have certain properties. In such conditions the barrel of the weapon needs to have a considerable elevation in order for the ammunition to reach the target. A normal sight will generally not suffice, since it is difficult or impossible to have a visual contact with the target via the sight and at the same time have the correct inclination of the barrel, thus aiming is impossible. Also the sight may need to cover a considerable interval of inclinations, which introduces further limitations. In this context it should be clarified that some weapons/ammunitions have an inherent high trajectory, while others only have high trajectory when applied under certain conditions, e.g. ammunition normally following a level trajectory in shorter ranges will generally fall within the definition of high trajectory if the distance they travel to the target is considerable. For the purpose of the present invention this is the relevant definition of high trajectory.

The known solution to the above problem has been to incorporate an iron sight, similar to those used for historical long guns, with a foldable primary part including distance markings, e.g. tang sight or ladder sight, such that if the distance is known, the correct distance marking can be used. This type of sight is still used, since it provides a rugged, simple solution.

More elaborate solutions include advanced optics, mechanics and computer software for calculating optimal aiming, and movement of a physical light-source inside the sight (see e.g. WO2004001324).

Though functional, more elaborate solutions generally are too complicated and thus not as rugged as one would prefer for field use or too heavy to be handheld with maintained user friendliness. The existence of moving parts inside the sight generally also increase power consumption, increase the response time, and makes the sight less versatile.

The present invention aims at providing a fire-control system relating to these and other drawbacks in prior-art.

SUMMARY OF THE INVENTION

When using high-trajectory ammunition in a field condition it is obviously important to maintain an elevated awareness regarding the events in the surroundings. Therefore it is beneficial and desired to have a fire-control system that does not include optics or electronics distorting the field of view, e.g. an optical or electronic system that creates a real or imaginary image of the target which is not in the line of sight between the aiming eye of the user and the actual target. Also, it is beneficial to be able to look at the target with the other eye while aiming.

The present invention aims at alleviating or eliminating the above and previously mentioned drawbacks and achieving the above benefits by the provision of a fire-control system in accordance with claim 1, and a method of displaying a reticle in accordance with claim 10 and a computer program in accordance with claim 15 Further embodiments are defined in the dependant claims.

It should be noted that even though the present fire-control system is especially well adapted for the purposes mentioned in the introduction, it may be used on any weapon to increase precision and first shot accuracy. It should also be noted that though the inventive fire-control system will been described by specific embodiments, it is, unless technically unfeasible, possible to add, remove or combine individual technical features of the sight to create new embodiments, not described. This is particularly true for the features defined in the appended claims.

To this end an inventive fire-control system comprises:

a housing; partially reflective optics, through which a user may observe a target and receive visually displayed information simultaneously; a light source, for visualization of a reticle to the user via the partially reflective optics; means for receiving a measure of the distance to the target; a processor, for determining the adequate position of the reticle, based on the distance to the target, and for controlling the light source to emit light so that the reticle is visualized at the adequate position; wherein the light source is an capable of selectively emitting light in well defined locations on its surface. According to one or more embodiments the fire-control system may also comprise a battery charge controller.

The use of said array provides several advantages over prior art, and in one or more embodiments the array is a one-dimensional array. A one-dimensional light-emitting array is in this context defined by a light source capable of emitting light from well-defined points on its surface, along one specific direction. The light-emitting array is a static component in the sense that it remains immovable during the operation of the fire-control system. A static component may be made more robust, as compared to a mobile component serving the same purpose. Further, several other components may be eliminated, such as the drive, suspension, guide means, etc. which are necessary if a mobile light source is used. This elimination reduces overall weight, chock sensitivity, power consumption and, not the least, cost.

The main purpose of the sight is obviously to assist the user in striking the target, and the fire-control system will provide a reticle to be superimposed on the target. It should be noted that there are other possibilities than to superimpose a reticle. The reticle could have another form, such as a crosshair form or a circular form, and these embodiments fall within the scope of the claim. The light-emitting array enables the display of a reticle, which is movable in a vertical direction, so as to be able to mark an aiming point for various distances to a target.

According to one or more embodiments the one-dimensional array may be curved, such as to adjust for, e.g., a known drift caused by the rotation of a projectile (i.e. the gyroscopic drift) without a need to move the one-dimensional array.

The position of the reticle is calculated on basis of the measured distance to the target. Further, the one-dimensional array makes it possible to emit light from several points of the array at the same time, which increases the functionality of the fire-control system. In the case of a miss of the target, the possibility of displaying several reticles may be useful when correcting the position of the reticle, e.g. by letting the used reticle remain on the target while another reticle is electronically moved the actual point of impact. In this way the processor may correct the calculation of the reticle so that the next firing will result in a hit.

The processor may include tables and/or algorithms regarding the performance of various types of ammunition. The apparent parameter needed is related to the trajectory for various distances, since the position of the reticle relies on this type of data. However, the processor enables far more advanced maneuvers, such as correction for wind speed, inclination, air pressure, humidity, corrections etc, and makes the fire-control system very versatile. Therefore, in one or more embodiments the fire-control system may also contain data regarding various types of ammunition, and in such cases this data is included in the acquisition of the position of the reticle. This acquisition may also include data regarding air speed, air temperature, humidity, tilt of the weapon in a cross direction, and other factors affecting the trajectory of the ammunition, and the choice of reticle. One further example is that there are two elevations for which the ammunition will hit the target, a lower elevation—resulting in a lower trajectory—and a higher elevation—resulting in a higher trajectory. Depending on the type of target, the terrain in front of the target, and the ammunition either the higher or the lower trajectory may be preferred. By providing the desired scenario to the CPU it may, if geometrically possible, show either one or both of the applicable reticles.

In the above context the term "position" relates to the position in a plane orthogonal to the line of sight between the eye of the user and the target. However, in many applications it is also important at what distance from the users eye the image of the lit part, i.e. the reticle, of the light source is located.

In one or more embodiments the light-emitting array is a two-dimensional array capable of selectively emitting light in well-defined locations on its surface. The two dimensional array makes the fire-control system even more versatile, since it enables the position of the reticle to be varied in the horizontal direction as well. This makes it possible to correct the position of the reticle in relation to offsets due to wind, poor alignment etc. The use of a two-dimensional light-emitting array facilitates software tuning of the fire-control system, making the production and quality assurance faster and less costly. When zeroing the weapon it may simply be fired at a target, after which the reticle is manually (by using input means for communication with the fire-control system) translated to the actual hit, after which the weapon is tuned for that particular type of ammunition. This results in a markedly decrease in ammunition and time consumed during tuning.

In one or more embodiments the fire-control system may be combined with equipment for infrared illumination and/or night-vision systems, which may increase the usability of the fire-control system.

The fire-control system according to one or more embodiments may also comprise a range finder, active or passive, within its housing. The use of an integrated rangefinder increases the fire-control systems versatility even further. Instead of relying on external data the user may now measure the distance to the target while looking through the fire-control system. The risk of potential misunderstanding decreases and the hit rate is likely to increase. The rangefinder is generally laser based and it should obviously not be subject to any trajectory correction, whereby a reticle related to the rangefinder may be displayed at all times when the fire-control system is in use.

The optics displaying the reticle for the user may comprise optics being adapted to create an image of the reticle which is essentially parallax free relative to the target. An essentially parallax free reticle significantly simplifies the task of the user, since there is no requirement to align any other components than to simply superimpose the reticle on the target and fire. If high-trajectory ammunition is used, the sight window through which the user observes the target is generally significantly larger than what is used for a normal telescopic sight since it should allow for a significant inclination of the weapon, and thus of the fire-control system, with maintained visual contact with the target through the fire-control system. An essentially parallax free reticle is generally created by having the optics generating an image at an infinite distance from the user, or at a typical distance for use, such as 300 m. This also means that the normal human eye may be relaxed, for the benefit of the user's ability to concentrate during long time. If the reticle is located at an infinite distance from the users eye, or 300 m, and the target is located 100 m away, there will be some parallax, though it has no significant impact on the precision of the weapon, as long as the user may still superpose the reticle on the target while looking in the fire-control system. Due to the fact that targets will be located at various distances a completely parallax free reticle is very difficult to achieve, which is why the word "essentially" have to be included. For the purpose of this invention "essentially parallax free" optics having inherent very low dependency on distance to observed object with regard to showing little or no parallax effects.

To further increase the versatility of the fire-control system according to one or more embodiments it may further comprise a gyro or other inclinometer for enabling measurement of the inclination of the fire-control system. Combined with the distance being known, a measure of the inclination makes it possible to account for an altitude difference between the fire-control system and the target, and to make the necessary corrections regarding trajectories and the calculated reticle. The gyro or inclinometer may obviously be combined with the capability of measuring the direction of the fire-control system in accordance with an established positioning standard, so that the processor of the fire-control system may calculate an absolute position of a target or itself. The gyro or inclinometer may also be used for determining rate of angular change and thereby the speed of the target and aim-off (lead) necessary in regard of a moving target etc. To that end the fire-control system may also comprise a positioning system, such as a Global Navigation Satellite System (GNNS), e.g. Navstar Global Positioning System (GPS) or an alternative positioning system. A compass may also be included, for measuring the direction of a target in relation to the fire-control system.

A fire-control system according to one or more embodiments may further comprise means for communication with external sources. The means for communication may be realized by regular connectors for keypads, transfer of data etc, and may also comprise means for communication with wireless means, such as a receiver/transmitter for electromagnetic radiation, radio frequency communication, etc. There are several cases when this may constitute an advantage, one example being the fire-control system receiving information regarding wind speed or other atmospheric conditions.

A method for displaying a reticle for a fire-control system according to one or more described embodiments during targeting with specific ammunition, comprises the main steps conducted during use of the fire-control system:

acquiring distance information representing a distance to a target;

determining a position for imaging the reticle based on said distance information and trajectory information for ammunition to be used; and controlling light emission from the array to emit light from a position of the surface of the array which via the partially reflective optics images reticle at the determined position.

In the step related to acquiring distance, may also include acquiring alternative or additional inputs may be used, some examples of which is illustrated in relation to FIG. 2. Further, the step of acquiring distance may include the substeps of:

transmitting electromagnetic radiation towards the target;

receiving a reflection of said electromagnetic radiation from the target; and calculating the distance to the target based on the time elapsed from the transmitting to the receiving.

A computer program for performing the method may be embodied on a computer-readable medium.

BRIEF DESCRIPTION OF THE DRAWINGS

FIG. 1 is a schematic illustration of the fire-control system according to a first embodiment of the invention, in a side view.

FIGS. 2A and 2B illustrate various configuration of a light-emitting array.

DESCRIPTION OF EMBODIMENTS

Figure 3:
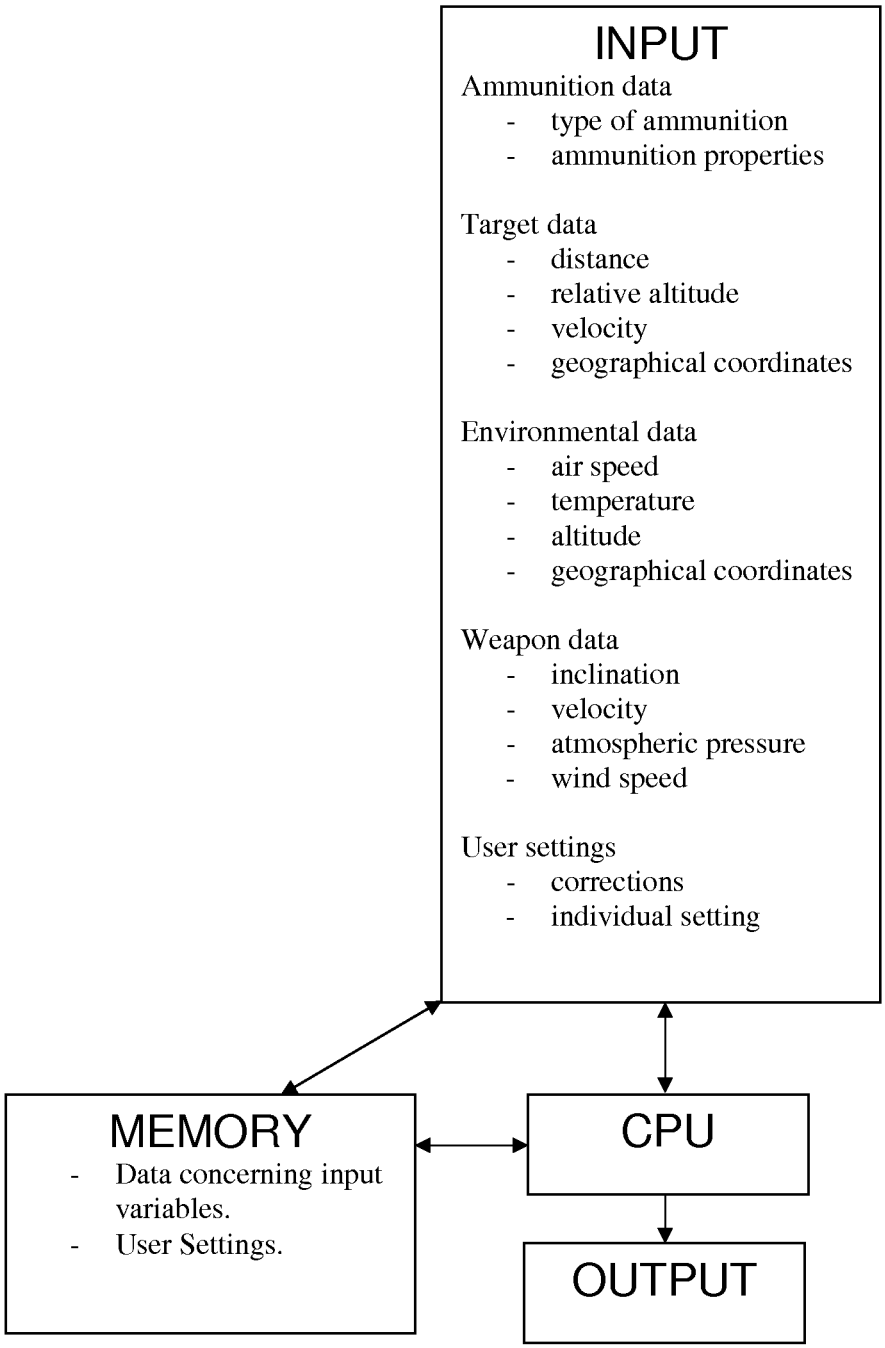
FIG. 3 is a block diagram illustrating the operations performed by the fire-control system of FIG. 1.

The general structure and function of the inventive fire-control system in the embodiment of a sight 1 is described referring to FIG. 1, which is a schematic representation of the sight, as viewed from one side. In the depicted view a target would be situated to the right, and the user to the left. The user may observe the target directly through a light channel housing an entrance window 2, an angled narrow-banded reflector 4, a dual lens system 6, 8, and a protective exit window 10 having essentially the same purpose as the entrance window 2. The entrance window 2 may also consist of a lens, which may be used to correct for possible distortions. All components will be defined in the following, and one important feature of the optical components are that they do not disturb the light path from the target to the eye of the user to any significant degree, by introducing distortion. It is also to be understood that the sight 1 as such is non-magnifying. A user may therefore observe a target in a direct fashion and with both eyes open, as oppose to a system that may use a camera and a display, or a system shifting the light-path in some way. The general purpose of the sight is to display a reticle at the correct position. Starting from the left the entrance window 2 acts as a protective window, and is arranged to enable moist sealing and dust sealing of a practical system. The next component is the inclined reflector 4, which is more intimately related to the imaging system and thus will be described later. Two spherical lenses 6, 8 of the dual lens system are arranged at the other end of the light channel, opposite to the protective window 2. The two lenses 6, 8, which are spherical, together perform the function of a parabolic mirror in relation to a reticle, which also will be described in relation to the imaging system. The imaging system of the fire-control system comprises a two-dimensional array 12 of light emitting diodes, preferably resonant cavity light emitting diodes (RCLED), which may be arranged to be very energy efficient, which is described in a previous application by the same applicant in relation to a single RCLED. In the following the two-dimensional array of RCLED:s will only be referred to as the "array" 12. The array 12 may be fully controlled via input from a CPU (not shown), so as to emit light from selected portions of its surface. Light from the array 12 will pass through a first and a second lens, 14 and 16, respectively, which together with the inclined reflector 4 generates an image of the array 12 placed in the focal plane of the lens system 6, 8, which in turn reflect the beams and generates a parallax free image of the array 12 for a user. By activating selected areas of the array 12 the user will consequently be able to observe a reticle (or other another type of indication) overlaying the target. The array 12 has a well defined wavelength $\lambda_a$ and the first and second lens 14, 16 transmits $\lambda_a$. The inclined reflector 4 reflects a portion of light having a wavelength $\lambda_a$, towards the lens system 6, 8. The lens system 6, 8 is adapted to reflect as much light having the wavelength $\lambda_a$ while transmitting light of any other wavelength. In this way a user may observe the target and the reticle simultaneously.

The imaging system, including the array 12, the lenses 14, 16, the inclined reflector 4 and the lens system 6, 8 are preferable integrated into a unit, such as to enable a rigid and robust construction able to maintain adequate precision while being handled roughly.

In one or more embodiments the light-emitting array 12 comprises a two-dimensional diode array of close-packed diodes (RCLED:s) having low power consumption. Such a diode array may be custom-built by IRnova (SE) or PRP Optoelectronics (GB). The wavelength of the emitted light is approximately 650 nm, well within the visible range, yet far enough from wavelength range where the human eye is the most sensitive (around 555 nm). The array may be quadratic or rectangular or have other more complex shapes, as will be described below.

FIGS. 2A and 2B illustrate two alternative embodiments of arrays 12, which may be used in relation to the present invention. The array disclosed in FIG. 2A is of standard design in regard of its shape, and the array of FIG. 2B has been invented for use in the present fire-control system and has a trapezoid shape. The shorter of the parallel sides of the trapezoid has a width of about 30-50 pixels, e.g. 40 pixels, and the longer of the parallel sides has a width of about 100-140 pixels, e.g. 120 pixels. The distance between the parallel sides may be about 150-200 pixels, e.g. 175 pixels.

Giving the array a trapezoid shape will result in several advantages, all relating to the fact that the function of the array will be maintained while its area will be reduced (both as compared to a conventional rectangular array). Firstly, and perhaps most importantly, the present applicant has not revealed any significant disadvantages, which makes it easier to appreciate the advantages. One advantage is that during production the array is cut from a substrate, and the inventive design enables more arrays to be produced from the same substrate. The array of FIG. 2B is arranged in the fire-control system 1 so that the narrow end may be used to image the reticle for targets being far away. The shape of the array results in a fewer number of pixels, which increases the yield during production.

The lens system 6, 8 may be coated so as to act as a bandpass filter, transmitting all visible wavelengths between 420 and 1100 nm but for a narrow wavelength interval including the wavelength emitted by the array 12, which itself is reflected. The longer wavelength are used for Night Vision Device (NVD).

Since the light from the array has a wavelength of e.g. 650 nm, most light will be transmitted, and in particular light in a wavelength range where the human eye is most sensitive.

The image generated is a virtual image created at an infinite distance from the user, in order to relax the eye of the user maximally. The user may observe the image through the protective window 2, the same window through which the target is observed. A second protective window 10 may, as have been mentioned above, be arranged in front of the lens system 6, 8. This protective window 10 may be inclined order to avoid reflections visible from the target area. Apart from protecting the sight from physical damage, the protective window 10 may also be coated to prevent transmission of hazardous radiation, such as infrared radiation from laser rangefinders, and in the absence of a second protective window 10 such coating may be provided on another optical surface of the system. Further, all optical surfaces may be coated with an anti-reflection (AR) coating to increase transmission. If external reflections are to be avoided the sight may be provided with a "killflash filter".

A third part of the sight may house the optional laser rangefinder 18 (see FIGS. 4 and 5), which may be of standard type operating at 1550 nm (not visible with standard night-vision systems) as well as the processing hardware, software and storage capabilities utilized. Other standard wavelengths used are around 900 nm, still in the infrared, and visible light. The latter having the disadvantage of exposing a visible flash of light. The laser rangefinder 18 is operated by the user, and the result of a distance measurement is used as an input to the processing section of the sight 1. The laser beam of the rangefinder will follow a rectilinear path, and thus a reticle for the rangefinder may be displayed at the same position in disregard of the distance to the target. The use of an integrated rangefinder 18 is preferred and preferable features for the rangefinder 18 for the intended application is high reliability and accuracy, low power consumption and low weight. In one or more embodiments the rangefinder may be tailor-made by Vectronix or JENOPTIK AG (DE), to fulfill the above preferences. These features are also important for the processing hardware, software and storage capabilities utilized. Existing possible processors include a main processor in the fire-control system and a processor in the handle (to be described referring to FIG. 6) both having a power consumption in an idle state of 0.1 μA. For other applications the weight and power consumption may be less important, and the sight need not be optimized in regard to the above parameters.

All components of the fire-control system may preferably be statically mounted, such as the array 12, and both the lens systems 14,16 and 6, 8, as well as the inclined reflector 4. As has been mentioned before, this will increase the ruggedness of the fire-control system as compared to a system where interior components are movable. There may be embodiments of the present invention too, however, that offer movable components, even if this is not the preferred construction.

Apart from visualizing the reticle, the array 12 may operate as an alphanumerical display, such that it can be used to display current information regarding distance, type of ammunition, etc.

FIG. 3 is a block diagram illustrating the processing section of the inventive sight. The block-diagram is a simplified diagram with the purpose of illustrating the operations of the sight 1. In use, data relating to a distance to a target and other optional inputs are transferred to the processor, which uses them in combination with relevant data from the memory to calculate the correct reticle. A control signal for controlling the array 12 is output from the processor, and the array 12 starts emitting light from a specific location (one or several) as a result.

The list in input section of FIG. 3 is extensive, and yet non-exhaustive. There are numerous of inputs that may be used for aiding in using the sight, whereof the type of ammunition and the distance to the target are two important inputs. One advantage of the present sight is that its construction allows it to be versatile, and basically any information affecting the trajectory of the ammunition used, or other parameters relevant for the user, may be used by the processor/microcontroller or displayed to the user. This information may also be communicated from the sight to other external units.

The distance to the target is generally measured with the rangefinder, but could also be input by the user, or by the sight receiving information by other means. The same is true for the type of ammunition, which either is detected automatically or input by the user.

The memory contains all information needed to control the sight. Such as tables and algorithms related to ammunition properties. The memory may communicate with external units such as to allow for updates, etc.

Figure 4:
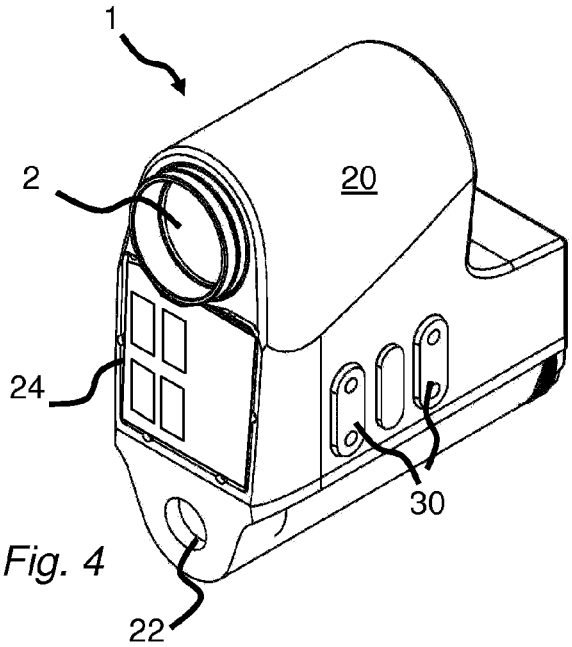
FIGS. 4 and 5 are perspective views of a fire-control system in accordance with an embodiment of the present invention.
Figure 5:
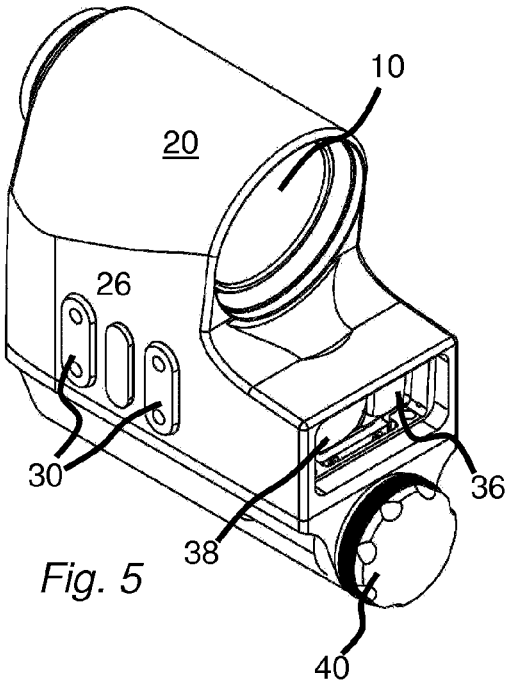

Examples of input variables include, but is not limited to Ammunition data, type of ammunition, ammunition properties (trajectories coupled to distance, wind speed etc.); Target data, distance, relative altitude, velocity, geographical coordinates; Environmental data, air speed, air temperature, geographical coordinates; Weapon data, inclination, velocity, atmospheric pressure, wind speed, geographical coordinates; User settings, manual inputs, corrections FIGS. 4 and 5 are perspective views of the fire-control system according to one embodiment. By comparison with corresponding reference numbers in FIG. 1 the alignment of the views of FIGS. 4 and 5, respectively, are self-explanatory.

Apart from what has already been described, FIG. 4 illustrates a housing 20. The housing 20 seals and protects the interior from water and impacts. The housing needs to be rigid and durable. In one embodiment it is made of extruded, high strength aluminum, which is anodized, providing a strong, rigid and durable housing with a low weight. There are other alternatives for the housing too, such as reinforced plastics or composite materials. The housing 20 has contact surfaces to other components, such as protection windows 2, 10 etc, and the choice of material is preferably such that the housing and related components have similar properties in relation to heat expansion. If not, it will be difficult to achieve a sight having adequate properties, and the choice of material may be made freely within the boundaries of that the sight preferably fulfills a harsh specification related to temperature, moisture etc. A lower portion of the housing 20, which portion may be a separate part attached to the housing, contains a power source in the form of a battery pack. This portion may also comprise a control device 22 for regulating the intensity of the light emitted by the array 12. The actual control of the RCLED intensity may be performed by varying pulse length to the RCLED in such a way that the human eye interprets it like a variation in intensity. This control method is thoroughly described in the application EP 1 210 561 A by the present applicant and will not be described in any further detail here, though the relevant details of said application are incorporated by reference. Also adjusting the current in the pulses can be used to increase the range in which the intensity can be set. This is specially important when using NVD.

A key pad 24 may be used as an interface between the sight and the user. The key pad 24 has a conventional functionality and is connected to control electronics of the sight in a conventional manner.

Further, mounts 30 for mounting the sight to a weapon are shown. Connections to remote control devices are preferable wireless, using e.g. suitable means for wireless communication. The use of wireless connections simplifies the task keeping the interior of the fire-control system protected from the outside environment (moist, dust, gases). If physical connectors are desired they may be arranged for at a suitable position, e.g. for a remote control and charging/communication/auxiliary devices. The remote control may be used to simplify input during shooting, such that the user can aim at a target having the correct shooting position and input data at the same time. The remote control could have a design similar to the keypad 24, or have a simplified design, comprising e.g. buttons for using the rangefinder and correcting the reticle only. FIG. 4 also illustrates the intensity knob 22, which is a rotary switch used in order to adjust the intensity of the reticle. Auxiliary devices include a keyboard, a GNSS receiver, a gyro device, an inclinometer, device for communication with the ammunition and/or any other element performing functions as demonstrated above with reference to FIG. 3. The auxiliary devices, or other types of external information, may communicate with the sight via a wire or via wireless communication, as discussed above. Wireless communication can also occur between the ammunition and the sight, such as information related to timing of the ammunition. Some or all of these devices may also be incorporated into the actual fire-control device. The connections may also be used for downloading new processing software and ammunition tables/algorithms etc.

FIG. 5 shows the fire-control system in a perspective view from a direction such that the output lens 36 and the receiving lens, 38 of the rangefinder 18 are visible. Opposite to the intensity knob 22, the battery cap 40 is shown. For ease of maintenance the sight preferably uses standard AA batteries, available all over the world, as energy source. Of course rechargeable AA batteries as well as Lithium batteries can be used.

Figure 6:
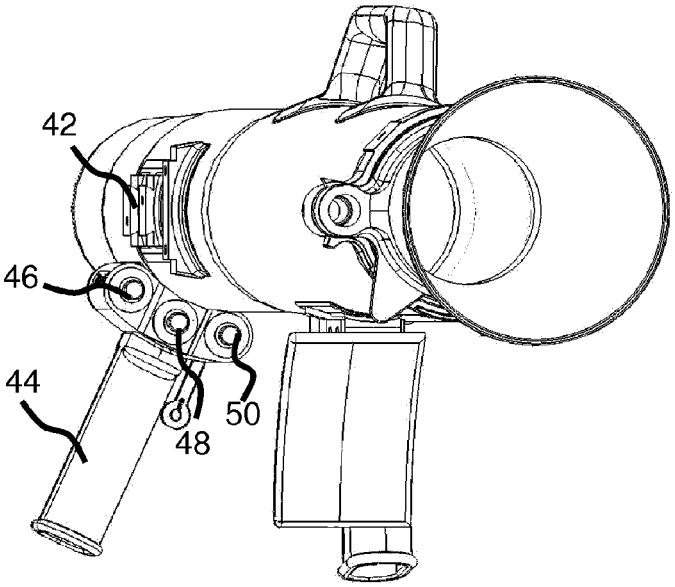
FIG. 6 is a perspective view of a grenade weapon having a handle adapted for control of the fire control system.
Figure 7:
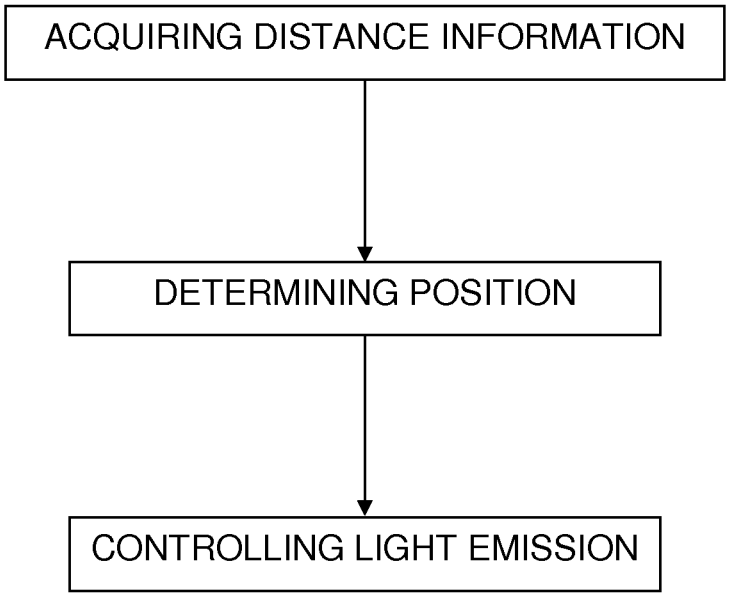
FIG. 7 is a flow chart of a method for displaying a reticle in a fire-control system in accordance to the invention.

FIG. 6 illustrates a recoilless grenade weapon provided onto which the inventive fire-control system may be mounted, on the mount 42. The fire-control system may then be connected to a control device, arranged on front handle 44 of the weapon. Three control buttons 46, 48, 50 are arranged within reach of a users thumb while gripping the front handle 44. The communication between the control device on the front handle 44 and the fire-control system is preferably wireless, e.g. via a Texas Instruments CC2500 low power transceiver.

When using the sight the user has to switch it on and, if it is used for a new purpose, initiate it by setting some user parameters, such as the type of ammunition used, various offsets etc. When looking in the sight and pushing the LRF (Laser Range Finder) knob the user will then see a static illuminated reticle, which is used to direct the rangefinder onto a target and zeroed with the rangefinder. When the static illuminated reticle is superimposed over the target the rangefinder may be activated, e.g. by releasing the knob. This action results in that the distance to the target is measured and can be displayed by the alphanumerical display. It can also result in that a second reticle, e.g. with pulsating intensity, is displayed to the user. The user may then have the opportunity to adjust the position of the second reticle in order to compensate for target movement, wind etc, before superimposing the second reticle over the target and firing the weapon, if any of these parameters is not compensated for by the fire-control system. After firing the weapon the position of the second reticle may be adjusted yet again. The second reticle may differ visually from the first, if displayed at the same time, in order to avoid confusion. The skilled person realizes that this can be achieved in several different ways.

Correction of the position of the reticle as a response to the inclination of the weapon will be described next. In order to achieve such a correction the sight, or the weapon, has to be provided with a sensor for measuring inclination, e.g. an inclinometer from Freescale Semiconductor. If the distance to the target was the only parameter to be considered the inclination in the length direction of the weapon would be accounted for in the initial target acquisition, i.e. by measuring the distance to the target. Another parameter that has to be accounted for, however, occurs when firing at a target being positioned at a lower or higher altitude than the weapon itself. Provided that the weapon receives information regarding difference in altitude this inclination too is accounted for when performing the initial acquisition of the target. This may be achieved by combining the information from the distance measurement with information from an inclinometer, detecting the inclination in the length direction of the weapon. The information may also be acquired from other sources. An inclination, or tilt, in the cross direction of the weapon may occur when the user is tilting the weapon by mistake. The tilt is less predictable than the inclination in the length direction, since it may be altered between the acquisition of the target and the actual moment of firing the weapon, and it is self explanatory how the tilt may cause a significant miss of the target. One way of eliminating the problem of tilt may be to introduce a virtual horizon, or other indication of how the weapon should be tilted in order to reach a horizontal position in the cross direction. According to another embodiment of the present invention, however, the CPU rapidly determines, by analyzing a signal from the inclination sensors, the tilt of the weapon, after which the position of the reticle is adjusted accordingly. One beneficial effect of the latter technique is that the information displayed to the user may be kept at a minimum, shortening the time between target acquisition and the first shot fired at the target. If the tilt of the weapon is too large, so that the adjusted position of the reticle is outside of the capacity of the array, the system may be adapted to provide an indication regarding how the weapon should be tilted back. One example of such an indication may be a twinkling arrow, or other shape that may not be confused with the reticle.

The method according to the present invention, as illustrated in the drawings is suitable for implementation with aid of processing means, such as computers and/or processors.

Figure 8:
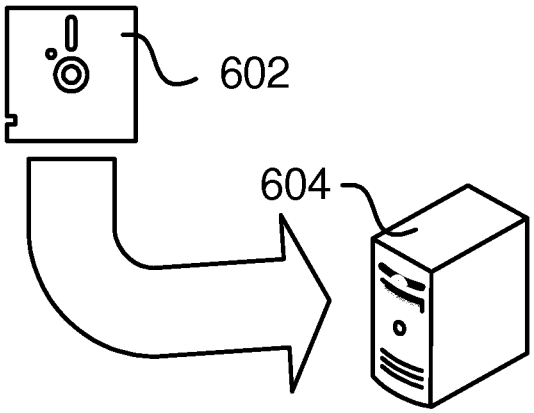
FIG. 8 illustrates a computer program for executing the method of FIG. 7

Therefore, there is provided a computer program comprising instructions arranged to cause the processing means, processor, or computer to perform the steps of the method according to any of the embodiments described or the method necessary to make the fire-control system according to any embodiment described operate in the desired manner. The steps are preferably performed by the processing means, processor, or computer in cooperation with physical means, such as those described with reference to any of the disclosed embodiments, with aid of e.g. an illumination control circuit powering the light source(s) of the array. The computer program preferably comprises program code, as illustrated in FIG. 8, which is stored on a computer readable medium 602, which can be loaded and executed by a processing means, processor, or computer 604 to cause it to perform the method according to the present invention, preferably as any of the exemplary embodiments described with reference to the drawings. The computer program can for example cause the processor to correct calculated trajectories to account for windage etc, or the compensated position for the reticle resulting from a tilt of the fire-control system.

The computer and computer program can be arranged to execute the program code sequentially where actions of the any of the methods are performed stepwise, or be arranged to execute the program code on a real-time basis where actions of any of the methods are performed upon need and availability of data. The processing means, processor, or computer is preferably what normally is referred to as an embedded system. Thus, the depicted computer readable medium 602 and computer 604 in FIG. 8 should be construed to be for illustrative purposes only to provide understanding of the principle, and not to be construed as any direct illustration of the elements.

The present invention is particularly well suited for weapons firing ammunition with a high trajectory, such as an underslung grenade launcher (UGL), automatic grenade launcher (AGL), recoilless grenade rifle (such as the Carl Gustaf), etc, and may to the full extent be used on such a weapon.

The invention claimed is:

1. A fire-control system comprising:

a housing, a light channel within the housing, through which a user may directly observe a target and receive visually displayed information simultaneously, said light channel comprising partially reflective optics that are statically mounted relative to the housing, a light source for visualization of a reticle to the user via the partially reflective optics, wherein the light source is statically mounted relative to the housing, means for receiving a measure of the distance to the target a processor configured to determine an adequate position of the reticle, based on the distance to the target, and to control the light source to emit light so that the reticle is visualized at the adequate position, wherein the light source is an array capable of selectively emitting light in well defined locations on its surface, and the partially reflective optics are adapted to reflect the light and image the emitted light for generation of a virtual reticle and to create an image of the reticle which is parallax free relative to the target, wherein a display lens system displaying the reticle for the user comprises one or more lens, together with an inclined reflector, are adapted to generate an image of the array placed in the focal plane of an exit lens system arranged at an exit window of the fire-control system, and wherein the exit lens system is adapted to reflect the reflected light and the emitted light and generate a parallax free image of the array for the user and an optical axis of the exit lens system is not parallel to an optical axis of the display lens system.

2. The fire-control system of claim 1, wherein the light-emitting array is a one-dimensional array capable of selectively emitting light in well defined locations on its surface.

3. The fire-control system of claim 1, wherein the light-emitting array is a two-dimensional array capable of selectively emitting light in well defined locations on its surface.

4. The fire-control system of claim 3, wherein the light-emitting array is an array of resonant-cavity light emitting diodes.

5. The fire-control system of claim 1, wherein the light-emitting array has a trapezoid shape.

6. The fire-control system of claim 1, wherein the fire-control system further comprises a range finder within its housing.

7. The fire-control system of claim 1, wherein the fire-control system further comprises a sensor for measuring inclination of the fire-control system in a cross-direction, and means for compensating the position of the position of the reticle responding to said inclination.

8. The fire-control system of claim 1, wherein the fire-control system further comprises means for communication with external sources.

* * * * *